US010557657B2

(12) United States Patent
Lindsay et al.

(10) Patent No.: US 10,557,657 B2
(45) Date of Patent: Feb. 11, 2020

(54) INFLATABLE ICE MAKING ASSEMBLY

(71) Applicants: Jordan Lindsay, Vancouver, WA (US); Tatyana Lindsay, Vancouver, WA (US)

(72) Inventors: Jordan Lindsay, Vancouver, WA (US); Tatyana Lindsay, Vancouver, WA (US)

( * ) Notice: Subject to any disclaimer, the term of this patent is extended or adjusted under 35 U.S.C. 154(b) by 339 days.

(21) Appl. No.: 15/690,367

(22) Filed: Aug. 30, 2017

(65) Prior Publication Data

US 2019/0063815 A1 Feb. 28, 2019

(51) Int. Cl.
*F25C 1/24* (2018.01)
*F25C 1/04* (2018.01)

(52) U.S. Cl.
CPC . *F25C 1/24* (2013.01); *F25C 1/04* (2013.01)

(58) Field of Classification Search
CPC ..... F25C 1/243; F25C 1/24; F25C 2400/06; F25C 2500/06; F25C 5/185; F25C 1/04; B65D 31/145; B65D 31/14; B65D 81/052; A47J 41/0072; F25D 2323/062
USPC ..... D15/90; 383/38, 44, 3, 57, 42, 45
See application file for complete search history.

(56) References Cited

U.S. PATENT DOCUMENTS 3,207,420 A 9/1965 Kindelan
3,306,567 A 2/1967 Frei, Sr.
3,684,235 A * 8/1972 Schupbach ..... F25C 1/24 249/127
D288,409 S 2/1987 Mikkelsen
4,804,083 A 2/1989 Weeks
4,815,691 A * 3/1989 Cooley ..... F25C 1/22 249/120
5,527,012 A 6/1996 Vinkel et al.
5,846,446 A 12/1998 Jackson
6,322,044 B1 11/2001 Vangedal-Nielsen
2006/0049328 A1* 3/2006 Vangedal-Nielsen ..... F25C 1/243 249/69

* cited by examiner

*Primary Examiner* — Leith S Shafi

(57) ABSTRACT

An inflatable ice making assembly for making ice cubes includes a shell, which has a first end that is open and a second end that is closed. The shell is resilient and impermeable. First panels and second panels, which are resilient, are coupled to and positioned in the shell to defines a plurality of air conduits. The first and second panels extend between opposing sides of the shell and are alternately positioned between a top and a bottom of the shell. Each first panel and an adjacently positioned second panel define a sleeve that is configured to add water. First recesses positioned in the first panels and second recesses positioned in the second panels define pockets that are configured to shape cubes of ice. A lid is couplable to the shell to close the first end. The shell is configured to be twisted to free the cubes from the pockets.

14 Claims, 6 Drawing Sheets

INFLATABLE ICE MAKING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to ice making assemblies and more particularly pertains to a new ice making assembly for making ice cubes.

BRIEF SUMMARY OF THE INVENTION

An embodiment of the disclosure meets the needs presented above by generally comprising a shell, which has a first end that is open and a second end that is closed. The shell is resilient and impermeable. First panels and second panels, which are resilient, are coupled to and positioned in the shell to defines a plurality of air conduits. The first and second panels extend between opposing sides of the shell and are alternately positioned between a top and a bottom of the shell. Each first panel and an adjacently positioned second panel define a sleeve that is configured to add water. First recesses positioned in the first panels and second recesses positioned in the second panels define pockets that are configured to shape cubes of ice. A lid is couplable to the shell to close the first end. The shell is configured to be twisted to free the cubes from the pockets.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
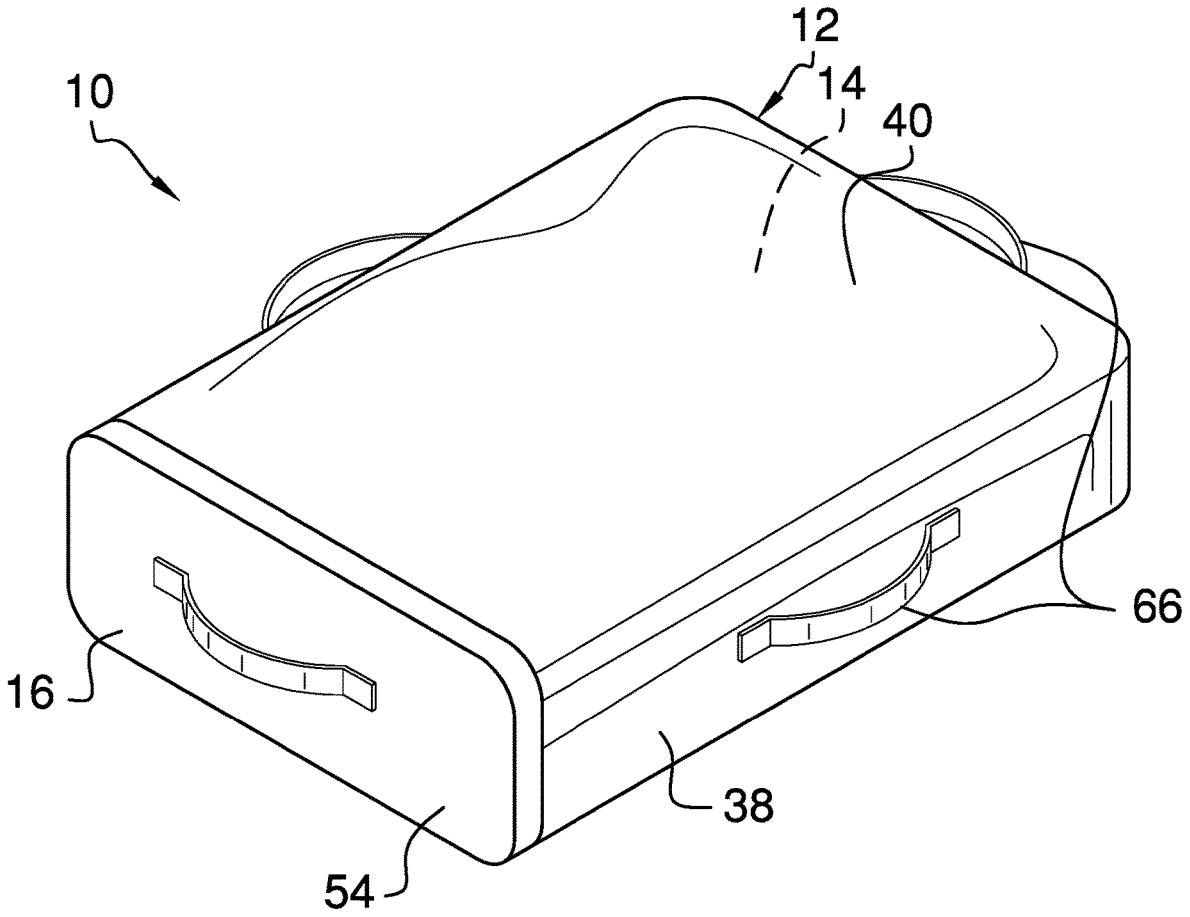
FIG. 1 is an isometric perspective view of an inflatable ice making assembly according to an embodiment of the disclosure.
Figure 2:
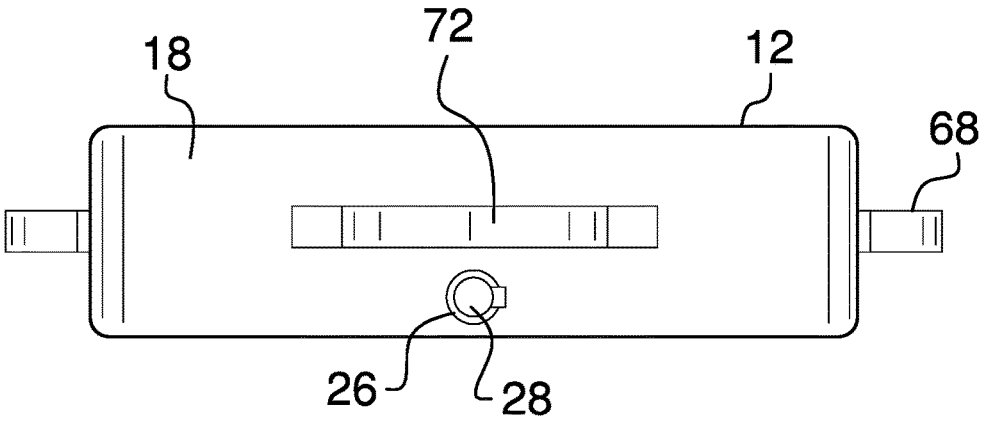
FIG. 2 is an end view of an embodiment of the disclosure.
Figure 3:
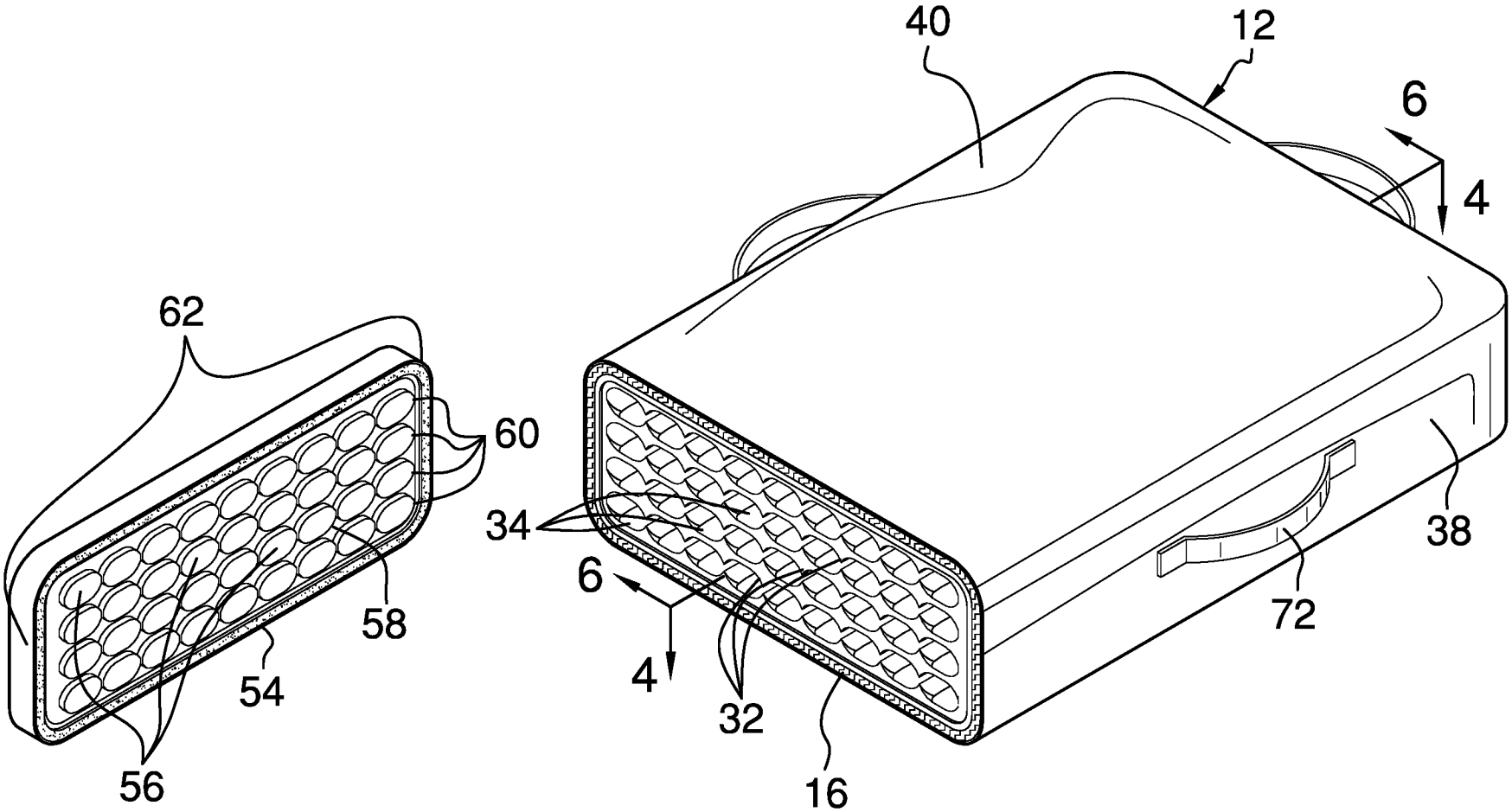
FIG. 3 is an isometric perspective view of an embodiment of the disclosure.
Figure 4:
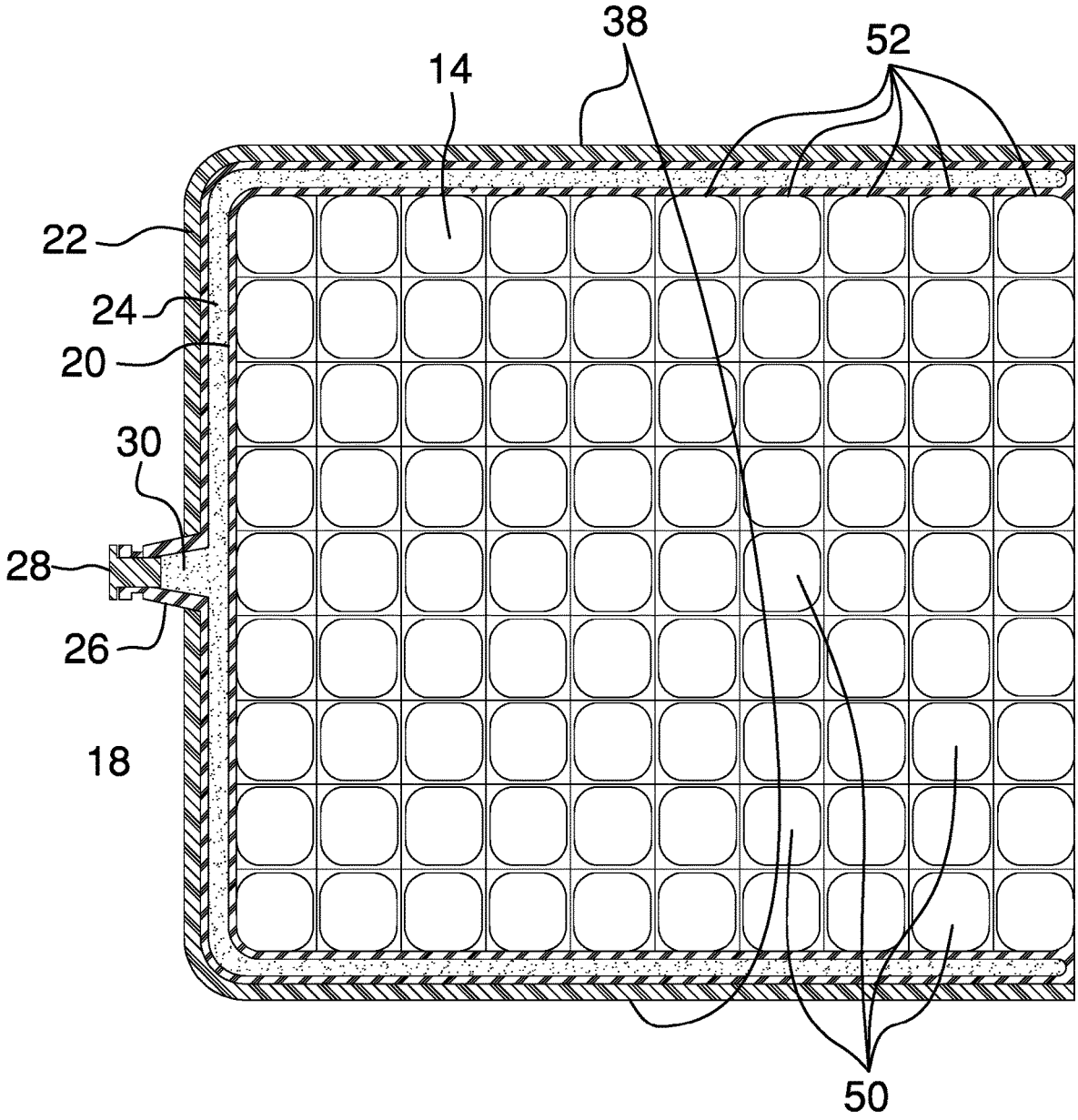
FIG. 4 is a cross-sectional view of an embodiment of the disclosure.
Figure 5:
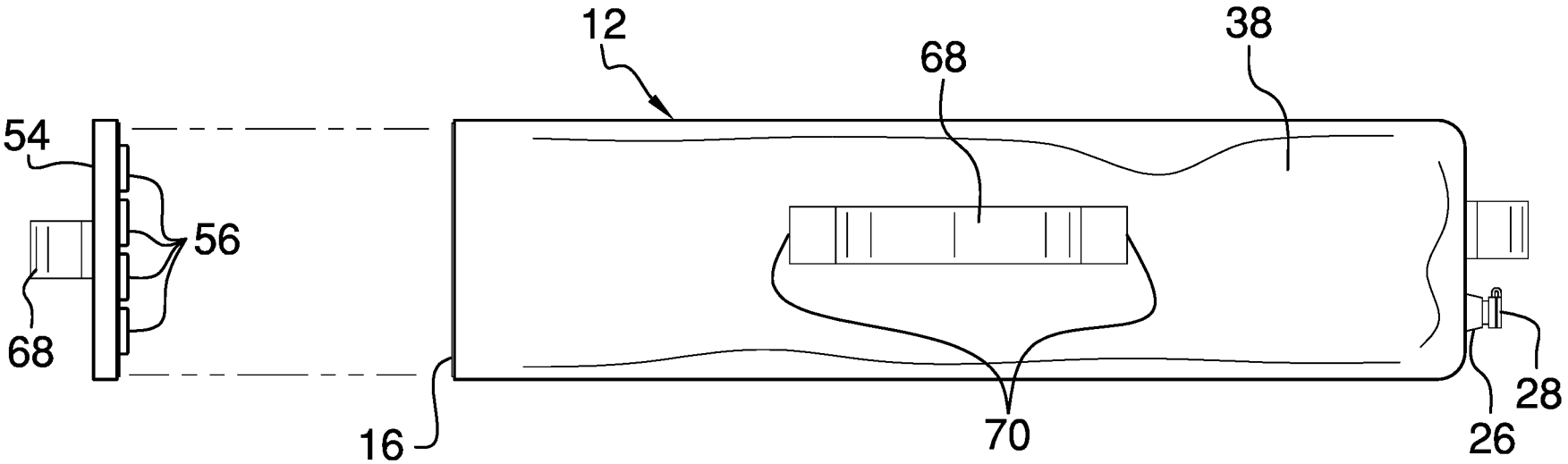
FIG. 5 is a side view of an embodiment of the disclosure.
Figure 6:
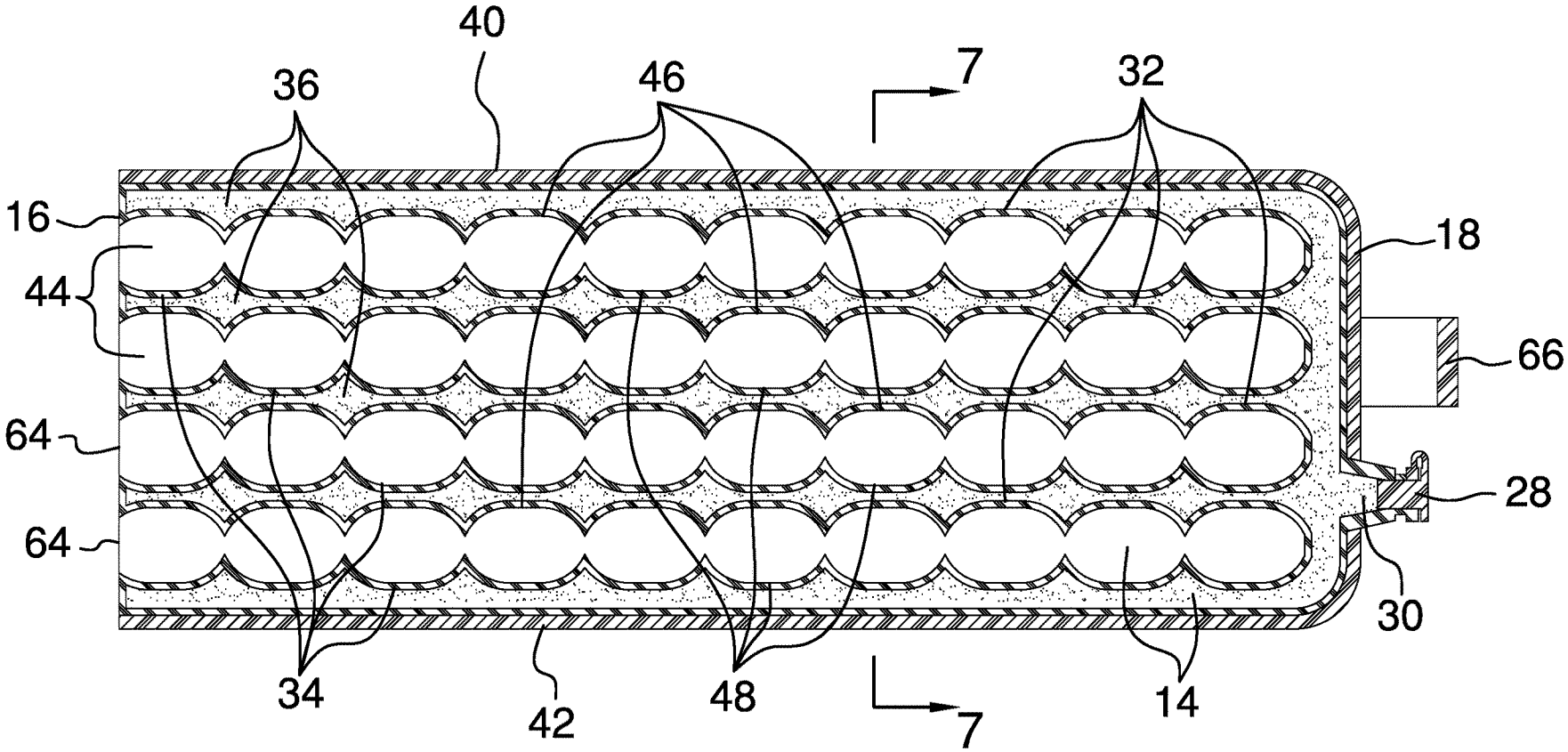
FIG. 6 is a cross-sectional view of an embodiment of the disclosure.
Figure 7:
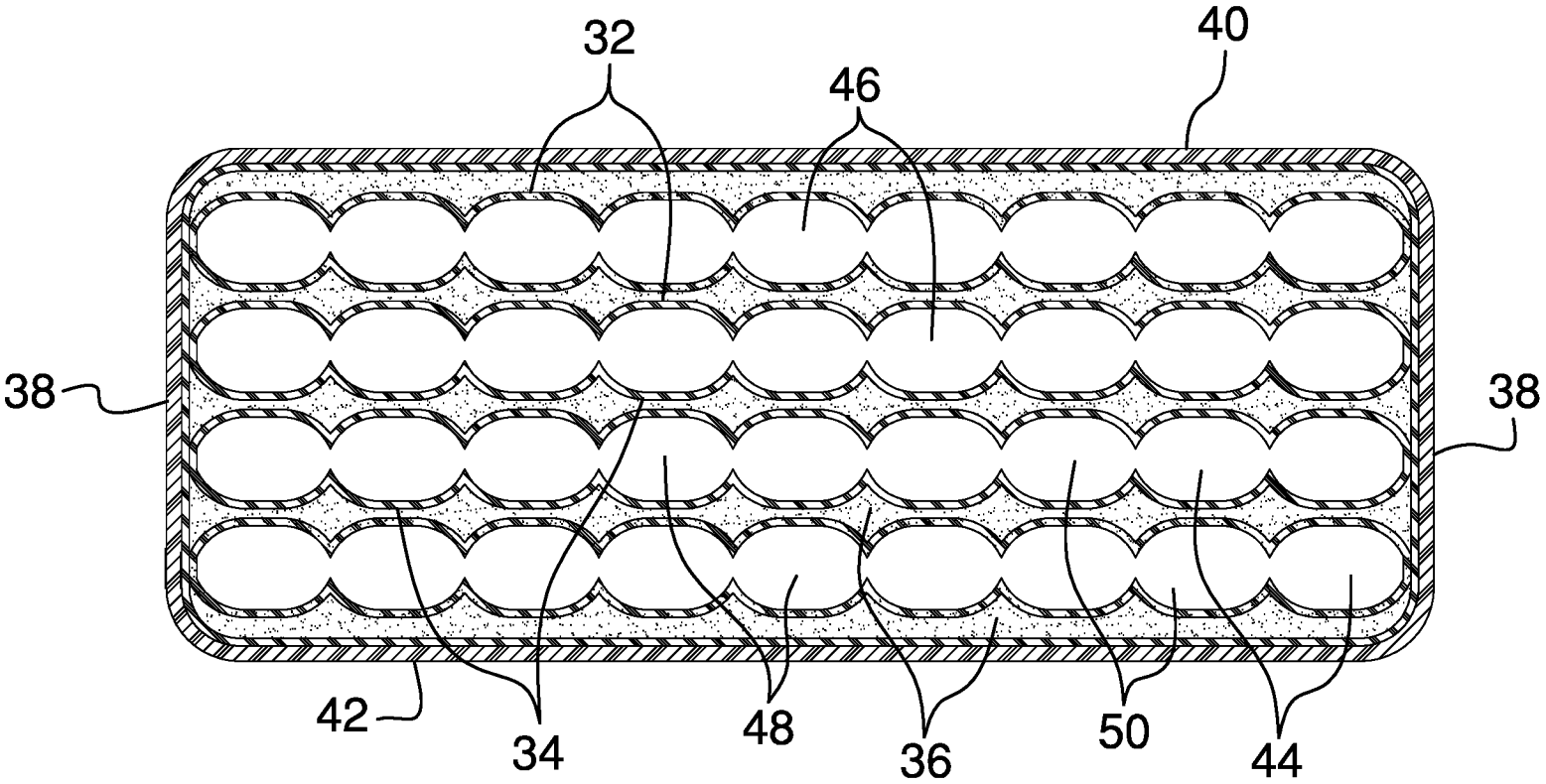
FIG. 7 is a cross-sectional view of an embodiment of the disclosure.

With reference now to the drawings, and in particular to FIGS. 1 through 7 thereof, a new ice making assembly embodying the principles and concepts of an embodiment of the disclosure and generally designated by the reference numeral 10 will be described.

As best illustrated in FIGS. 1 through 7, the inflatable ice making assembly 10 generally comprises a shell 12 that defines an interior space 14. The shell 12 has a first end 16 that is open and a second end 18 that is closed. The shell 12 is resilient so that the shell 12 is configured to be collapsed and twisted. The shell 12 is impermeable. In one embodiment, the shell 12 is substantially rectangularly box shaped. In another embodiment, the shell 12 comprises silicone.

The shell 12 comprises an inner layer 20 and an outer layer 22. The inner layer 20 and the outer layer 22 define a chamber 24. A valve 26 is positioned through the outer layer 22. The valve 26 is fluidically coupled to the chamber 24. The valve 26 is configured to force air into the chamber 24 to stiffen the shell 12 and to insulate the interior space 14. In one embodiment, the valve 26 is positioned on the second end 18 of the shell 12.

A cap 28 is hingedly coupled to the valve 26 distal from the shell 12. The cap 28 is complementary to an orifice 30 of the valve 26. The cap 28 is selectively couplable to the valve 26 to close the orifice 30. The cap 28 is positioned to decouple from the valve 26 so that the valve 26 is configured to force the air through the orifice 30 into the chamber 24 to stiffen the shell 12 and to insulate the interior space 14. The cap 28 is positioned couple to the valve 26 to close the orifice 30 to retain the air in the chamber 24. The cap 28 is positioned to decouple from the valve 26 so that the valve 26 is configured to allow the air to exit from the chamber 24 to collapse the shell 12.

A plurality of first panels 32 and a plurality of second panels 34 are coupled to the shell 12 and are positioned in the interior space 14 to defines a plurality of air conduits 36. Each first panel 32 and each second panel 34 extend between opposing sides 38 of the shell 12. The first panels 32 and the second panels 34 are alternately positioned between a top 40 and a bottom 42 of the shell 12. Each first panel 32 and an adjacently positioned second panel 34 define a sleeve 44. The first panels 32 and the second panels 34 are resilient. The sleeves 44 are configured to add water.

In one embodiment, each first panel 32 and each second panel 34 extend from the first end 16 to proximate to the second end 18. In another embodiment, each first panel 32 and the adjacently positioned second panel 34 are coupled proximate to the second end 18 of the shell 12. In yet another embodiment, the plurality of first panels 32 comprises four first panels 32 and the plurality of second panels 34 comprises four second panels 34.

A plurality of first recesses 46 is positioned in the first panels 32 and extends toward the top 40. A plurality of second recesses 48 is positioned in the second panels 34 and extends toward the bottom 42. Each second recess 48 and an associated first recess 46 define a pocket 50. When the shell 12 is positioned in a freezer, the pockets 50 are configured to shape cubes of ice that are formed from water that is positioned in the pockets 50.

In one embodiment, the first recesses 46 and the second recesses 48 are arcuate. In another embodiment, the pockets 50 are positioned in a plurality of rows 52. Each row 52 extends between the opposing sides 38 of the shell 12. The plurality of rows 52 extends from the first end 16 to proximate to the second end 18 of the shell 12.

The assembly 10 comprises a lid 54 that is complementary to the first end 16 of the shell 12. The lid 54 is selectively couplable to the shell 12 to close the first end 16 to retain the water in the sleeves 44. A plurality of protrusions 56 is coupled to an inner face 58 of the lid 54. The protrusions 56 are positioned in a plurality of lines 60. Each line 60 extends between opposing edges 62 of the lid 54. The line 60 is complementary to an opening 64 of an associated sleeve 44. The opening 64 of the associated sleeve 44 is positioned to insert an associated line 60 of the protrusions 56 to seal the associated sleeve 44. In one embodiment, the protrusions 56 comprise silicone.

A plurality of handles 66 is coupled to the shell 12. Each handle 66 is configured to be grasped in a hand of a user to lift and manipulate the shell 12, such as to twist the shell 12 to free the cubes of ice from the pockets 50. In one embodiment, the plurality of handles 66 comprises four handles 66 that are positioned singly on the lid 54, the second end 18, and the opposing sides 38 of the shell 12. In another embodiment, each handle 66 comprises a strap 68 that has opposing ends 70. Each opposing end 70 is coupled to the shell 12 to define a loop 72. Each loop 72 is configured to be grasped in the hand of the user to lift and manipulate the shell 12, such as to twist the shell 12 to free the cubes of ice from the pockets 50.

In use, the cap 28 is positioned to decouple from the valve 26. The valve 26 is configured to force the air through the orifice 30 into the chamber 24 to stiffen the shell 12 and to insulate the interior space 14. The cap 28 is positioned couple to the valve 26 to close the orifice 30 to retain the air in the chamber 24. The sleeves 44 are configured to add the water through the openings 64. The opening 64 of the associated sleeve 44 is positioned to insert the associated line 60 of protrusions 56 to seal the associated sleeve 44. When the shell 12 is positioned in the freezer, the pockets 50 are configured to shape the cubes of ice that are formed from the water that is positioned in the pockets 50. Each loop 72 is configured to be grasped in the hand of the user to lift and manipulate the shell 12, such as to twist the shell 12 to free the cubes of ice from the pockets 50. The cap 28 is positioned to decouple from the valve 26 so that the valve 26 is configured to allow the air to exit from the chamber 24 to collapse the shell 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An inflatable ice making assembly comprising:

a shell defining an interior space, said shell having a first end and a second end, said first end being open, said second end being closed, said shell being resilient such that said shell configured for collapsing and twisting, said shell being impermeable;

a plurality of first panels and a plurality of second panels coupled to said shell and positioned in said interior space defining a plurality of air conduits, each said first panel and each said second panel extending between opposing sides of said shell, said first panels and said second panels being alternately positioned between a top and a bottom of said shell such that each said first panel and an adjacently positioned said second panel define a sleeve, said first panels and said second panels being resilient;

a plurality of first recesses positioned in said first panels and extending toward said top;

a plurality of second recesses positioned in said second panels and extending toward said bottom such that each said second recess and an associated said first recess define a pocket;

a lid complementary to said first end of said shell, said lid being selectively couplable to said shell for closing said first end for retaining the water in said sleeves; and wherein said sleeves are positioned in said shell such that said sleeves are configured for adding water, wherein said pockets are positioned in said shell such that said pockets are configured for shaping cubes of ice formed from water positioned in said pockets when said shell is positioned in a freezer, and wherein said shell is configured for twisting for freeing the cubes of ice from said pockets said shell comprising an inner layer and an outer layer, said inner layer and said outer layer defining a chamber;

a valve positioned through said outer layer such that said valve is fluidically coupled to said chamber;

a cap coupled to said valve distal from said shell, said cap being complementary to an orifice of said valve, said cap being selectively couplable to said valve for closing said orifice; and wherein said valve is positioned on said shell such that said valve is configured for forcing air into said chamber for stiffening said shell and for insulating said interior space, wherein said cap is positioned on said valve such that said cap is positioned for decoupling from said valve such that said valve is configured for forcing the air through said orifice into said chamber for stiffening said shell and for insulating said interior space, wherein said cap is positioned on said valve such that said cap is positioned coupling to said valve for closing said orifice for retaining the air in said chamber, wherein said cap is positioned on said valve such that said cap is positioned for decoupling from said valve such that said valve is configured for exiting of the air from said chamber for collapsing said shell.

2. The assembly of claim 1, further including said shell being substantially rectangularly box shaped.

3. The assembly of claim 1, further including said shell comprising silicone.

4. The assembly of claim 1, further including said valve being positioned on said second end of said shell.

5. The assembly of claim 1, further including each said first panel and each said second panel extending extending between said first end and said second end, each said first panel and said adjacently positioned said second panel being coupled to said second end of said shell.

6. The assembly of claim 1, further including said plurality of first panels comprising four said first panels and said plurality of second panels comprising four said second panels.

7. The assembly of claim 1, further including said first recesses and said second recesses being arcuate.

8. The assembly of claim 1, further including said pockets being positioned in a plurality of rows, each said row extending between said opposing sides of said shell, said plurality of rows extending between said first end and said second end.

9. The assembly of claim 1, further including a plurality of protrusions coupled to an inner face of said lid, said protrusions being positioned in a plurality of lines, each said line extending between opposing edges of said lid such that said line is complementary to an opening of an associated said sleeve, wherein said protrusions are positioned on said lid such that said opening of said associated said sleeve is positioned for inserting an associated said line of said protrusions for sealing said associated said sleeve.

10. The assembly of claim 9, further including said protrusions comprising silicone.

11. The assembly of claim 1, further including a plurality of handles coupled to said shell, wherein said handles are positioned on said shell such that each said handle is configured for grasping in a hand of a user for lifting and manipulating said shell, such as for twisting said shell for freeing the cubes of ice from said pockets.

12. The assembly of claim 11, further including said plurality of handles comprising four said handles positioned singly on said lid, said second end, and said opposing sides of said shell.

13. The assembly of claim 11, further including each said handle comprising a strap having opposing ends, each said opposing end being coupled to said shell defining a loop, wherein said straps are positioned on said shell such that each said loop is configured for grasping in the hand of the user for lifting and manipulating said shell, such as for twisting said shell for freeing the cubes of ice from said pockets.

14. An inflatable ice making assembly comprising:

a shell defining an interior space, said shell having a first end and a second end, said first end being open, said second end being closed, said shell being resilient such that said shell configured for collapsing and twisting, said shell being impermeable, said shell being substantially rectangularly box shaped, said shell comprising silicone, said shell comprising an inner layer and an outer layer, said inner layer and said outer layer defining a chamber;

a valve positioned through said outer layer such that said valve is fluidically coupled to said chamber, wherein said valve is positioned on said shell such that said valve is configured for forcing air into said chamber for stiffening said shell and for insulating said interior space, said valve being positioned on said second end of said shell;

a cap hingedly coupled to said valve distal from said shell, said cap being complementary to an orifice of said valve, said cap being selectively couplable to said valve for closing said orifice, wherein said cap is positioned on said valve such that said cap is positioned for decoupling from said valve such that said valve is configured for forcing the air through said orifice into said chamber for stiffening said shell and for insulating said interior space, wherein said cap is positioned on said valve such that said cap is positioned coupling to said valve for closing said orifice for retaining the air in said chamber, wherein said cap is positioned on said valve such that said cap is positioned for decoupling from said valve such that said valve is configured for exiting of the air from said chamber for collapsing said shell;

a plurality of first panels and a plurality of second panels coupled to said shell and positioned in said interior space defining a plurality of air conduits, each said first panel and each said second panel extending between opposing sides of said shell, said first panels and said second panels being alternately positioned between a top and a bottom of said shell such that each said first panel and an adjacently positioned said second panel define a sleeve, said first panels and said second panels being resilient, wherein said sleeves are positioned in said shell such that said sleeves are configured for adding water, each said first panel and each said second panel extending between said first end and said second end, each said first panel and said adjacently positioned said second panel being coupled to said second end of said shell, said plurality of first panels comprising four said first panels and said plurality of second panels comprising four said second panels;

a plurality of first recesses positioned in said first panels and extending toward said top, said first recesses being arcuate;

a plurality of second recesses positioned in said second panels and extending toward said bottom such that each said second recess and an associated said first recess define a pocket, wherein said pockets are positioned in said shell such that said pockets are configured for shaping cubes of ice formed from water positioned in said pockets when said shell is positioned in a freezer, said second recesses being arcuate, said pockets being positioned in a plurality of rows, each said row extending between said opposing sides of said shell, said plurality of rows extending between said first end and said second end;

a lid complementary to said first end of said shell, said lid being selectively couplable to said shell for closing said first end for retaining the water in said sleeves;

a plurality of protrusions coupled to an inner face of said lid, said protrusions being positioned in a plurality of lines, each said line extending between opposing edges of said lid such that said line is complementary to an opening of an associated said sleeve, wherein said protrusions are positioned on said lid such that said opening of said associated said sleeve is positioned for inserting an associated said line of said protrusions for sealing said associated said sleeve, said protrusions comprising silicone;

a plurality of handles coupled to said shell, wherein said handles are positioned on said shell such that each said handle is configured for grasping in a hand of a user for lifting and manipulating said shell, such as for twisting said shell for freeing the cubes of ice from said pockets, said plurality of handles comprising four said handles positioned singly on said lid, said second end, and said opposing sides of said shell, each said handle comprising a strap having opposing ends, each said opposing end being coupled to said shell defining a loop, wherein said straps are positioned on said shell such that each said loop is configured for grasping in the hand of the user for lifting and manipulating said shell, such as for twisting said shell for freeing the cubes of ice from said pockets; and wherein said cap is positioned on said valve such that said cap is positioned for decoupling from said valve such that said valve is configured for forcing the air through said orifice into said chamber for stiffening said shell and for insulating said interior space, wherein said cap is positioned on said valve such that said cap is positioned coupling to said valve for closing said orifice for retaining the air in said chamber, wherein said sleeves are positioned in said shell such that said sleeves are configured for adding the water through said openings, wherein said protrusions are positioned on said lid such that said opening of said associated said sleeve is positioned for inserting said associated said line of said protrusions for sealing said associated said sleeve, wherein said pockets are positioned in said shell such that said pockets are configured for shaping the cubes of ice formed from the water positioned in said pockets when said shell is positioned in the freezer, wherein said straps are positioned on said shell such that each said loop is configured for grasping in the hand of the user for lifting and manipulating said shell, such as for twisting said shell for freeing the cubes of ice from said pockets, wherein said cap is positioned on said valve such that said cap is positioned for decoupling from said valve such that said valve is configured for exiting of the air from said chamber for collapsing said shell.

* * * * *